US011241771B2

(12) United States Patent
Chen et al.

(10) Patent No.: US 11,241,771 B2
(45) Date of Patent: Feb. 8, 2022

(54) AUTO-POSITIONING HYDRAULIC PNEUMATIC FIXTURE

(71) Applicant: YUE DAR INDUSTRY CO., LTD, Taichung (TW)

(72) Inventors: Po-Shen Chen, Taichung (TW); Ju-Tan Chen, Taichung (TW)

(73) Assignee: YUE DAR INDUSTRY CO., LTD, Taichung (TW)

( * ) Notice: Subject to any disclaimer, the term of this patent is extended or adjusted under 35 U.S.C. 154(b) by 191 days.

(21) Appl. No.: 16/830,709

(22) Filed: Mar. 26, 2020

(65) Prior Publication Data

US 2021/0299821 A1 Sep. 30, 2021

(51) Int. Cl.

| | |
|---|---|
| ***B25B 5/00*** | (2006.01) |
| ***B25B 5/06*** | (2006.01) |
| ***B25B 5/02*** | (2006.01) |

(52) U.S. Cl.

CPC ..... *B25B 5/061* (2013.01); *B25B 5/02* (2013.01)

(58) Field of Classification Search

CPC .. B25B 5/00; B25B 5/163; B25B 5/06; B25B 11/00; B25B 11/02; B23Q 3/00; B23Q 3/06; B23Q 3/067; B23Q 3/154

See application file for complete search history.

(56) References Cited

U.S. PATENT DOCUMENTS

| | | | | |
|---|---|---|---|---|
| 5,056,766 | A * | 10/1991 | Engibarov | B25B 5/08 269/136 |
| 5,060,920 | A * | 10/1991 | Engibarov | B25B 1/2452 269/282 |
| 6,158,728 | A * | 12/2000 | Smith | B25B 5/006 269/88 |
| 2021/0299821 | A1* | 9/2021 | Chen | B25B 5/087 |

* cited by examiner

*Primary Examiner* — Lee D Wilson

(74) *Attorney, Agent, or Firm* — Karin L. Williams; Alan D. Kamrath; Mayer & Williams PC

(57) ABSTRACT

An auto-positioning hydraulic pneumatic fixture contains a base, at least one locking device, multiple pistons, multiple positioning modules, and multiple platforms. The base includes at least one installation zone for fixing at least one locking device. A respective one locking device includes a fixing module and a clamping module. The fixing module has a body, a connection segment, and an affix portion. The clamping module includes a positioning bolt and a pair of clamp units, and each clamp unit has a clamping face. The affix portion has a defining groove and a linear slot. The body has at least one tilted rail, and a respective one positioning module has a mounting unit and at least one locating unit. The mounting unit has two oblique faces and multiple fringes, and s respective one platform is configured to fix the respective one workpiece.

6 Claims, 10 Drawing Sheets

AUTO-POSITIONING HYDRAULIC PNEUMATIC FIXTURE

FIELD OF THE INVENTION

The present invention relates to a fixture for machining equipment, and more particularly to an auto-positioning hydraulic pneumatic fixture.

BACKGROUND OF THE INVENTION

In automatic machining process, it is troublesome to fix a workpiece easily and securely. For example, when fixing or removing the workpiece manually, the workpiece cannot be fixed with even exert force. When the workpiece is fixed with insufficient exert force, the workpiece removes from the fixture. When fixing the workpiece with excessive exert force, the workpiece is deformed. To overcome aforesaid-mentioned problem, the fixture is driven pneumatically or hydraulically via a medium.

To machine the workpiece accurately, at least one movable positioning unit is arranged on the fixture so as to fix the workpiece on the fixture, thus machining the workpiece. However, before machining the workpiece, the at least one movable positioning unit has to be removed. When the at least one movable positioning unit is not removed before machining the workpiece, it interferes the machining process.

In addition, it is time-consuming to align the fixture with the at least one movable positioning unit, thus increasing fabrication cost.

The present invention has arisen to mitigate and/or obviate the afore-described disadvantages.

SUMMARY OF THE INVENTION

The primary aspect of the present invention is to provide an auto-positioning hydraulic pneumatic fixture which contains a respective one of multiple positioning modules retracted into the fixing module after clamping the respective one workpiece, thus avoiding the obstruction of machining process.

Another aspect of the present invention is to provide an auto-positioning hydraulic pneumatic fixture which is linked with the machining equipment so as to be driven pneumatically or hydraulically easily.

To obtain above-mentioned aspects, an auto-positioning hydraulic pneumatic fixture provided by the present invention contains: a base and at least one locking device.

The base is mounted on machining equipment and includes at least one installation zone, and a respective one of the at least one installation zone is configured to fix a respective one of the at least one locking device.

The respective one locking device is configured to clamp a respective one of at least one workpiece, and the respective one locking device includes a fixing module and a clamping module. The fixing module has a body, a connection segment, and an affix portion. The body is configured to accommodate the connection segment and the affix portion.

The connection segment is arranged on a bottom of the body and is connected in the respective one installation zone, and the respective one locking device is fixed on the base by ways of multiple coupling elements.

The clamping module of the respective one locking device includes a pair of clamp units, and a respective one of the pair of clamp units has a clamping face. The clamping module further includes a positioning bolt extending from a bottom of the respective one clamp unit and inserted into the affix portion. The clamping module is secured on the affix portion, and the affix portion has a defining groove configured to accommodate the respective one clamp unit so as to fix the respective one workpiece. The affix portion has a linear slot so that the affix portion slides along the linear slot to actuate the respective one clamp unit to clamp the respective one workpiece, and the respective one clamp unit moves along of the affix portion of the fixing module linearly. The auto-positioning hydraulic pneumatic fixture further contains: multiple pistons, multiple positioning modules, and multiple platforms. A respective one of the multiple pistons, the multiple positioning modules, and the multiple platforms is fixed in the respective one installation zone, a first end of the respective one piston is fixed in the respective one installation zone, and a second end of the respective one piston is connected with a respective one of the multiple positioning modules. The respective one piston moves linearly in the respective one installation zone via a medium.

The body has at least one tilted rail configured to move the respective one positioning module linearly.

The respective one positioning module has a mounting unit and at least one locating unit, the mounting unit is configured to fix the at least one locating unit which is connected with the respective one piston. The mounting unit has two oblique faces formed on two sides thereof respectively so as to push the affix portion, and the mounting unit has multiple fringes configured to move the mounting unit along the at least one tilted rail of the body, such that the respective one positioning module is actuated by the respective one piston to move linearly along the at least one tilted rail, and the at least one locating unit extends out of or retracts into the fixing module of the respective one locking device. The at least one locating unit of the respective one positioning module is configured to position the respective one workpiece.

The respective one platform is configured to fix the respective one workpiece, the respective one platform is formed in a plate shape, and each of two ends of the respective one platform is clamped by the respective one clamp unit of the clamping module. The respective one platform includes at least one orifice, and a respective one of the at least one orifice is configured to extend a respective one of the at least one locating unit.

When unclamping the respective one workpiece, the respective one clamp unit of the clamping module is pushed by the mounting unit to extend outward, and the respective one locating unit of the respective one positioning module extends out of the respective one orifice so that the respective one workpiece is fixed.

When clamping the respective one workpiece, the clamping module is not pushed by the mounting unit and retracts inward to clamp the respective one workpiece and the respective one platform, and the respective one locating unit of the respective one positioning module is actuated by the respective one piston to retract into the fixing module.

Preferably, the respective one locating unit has a guide end.

Preferably, the medium is compressed air configured to push the respective one piston to move in the respective one installation zone.

Preferably, the medium is hydraulic oil configured to push the respective one piston to move in the respective one installation zone.

Preferably, the clamping module clamps or unclamps the respective one workpiece by ways of the medium.

Preferably, the clamping module is a vise or a chuck driven by the medium.

DETAILED DESCRIPTION OF THE PREFERRED EMBODIMENTS

Figure 1:
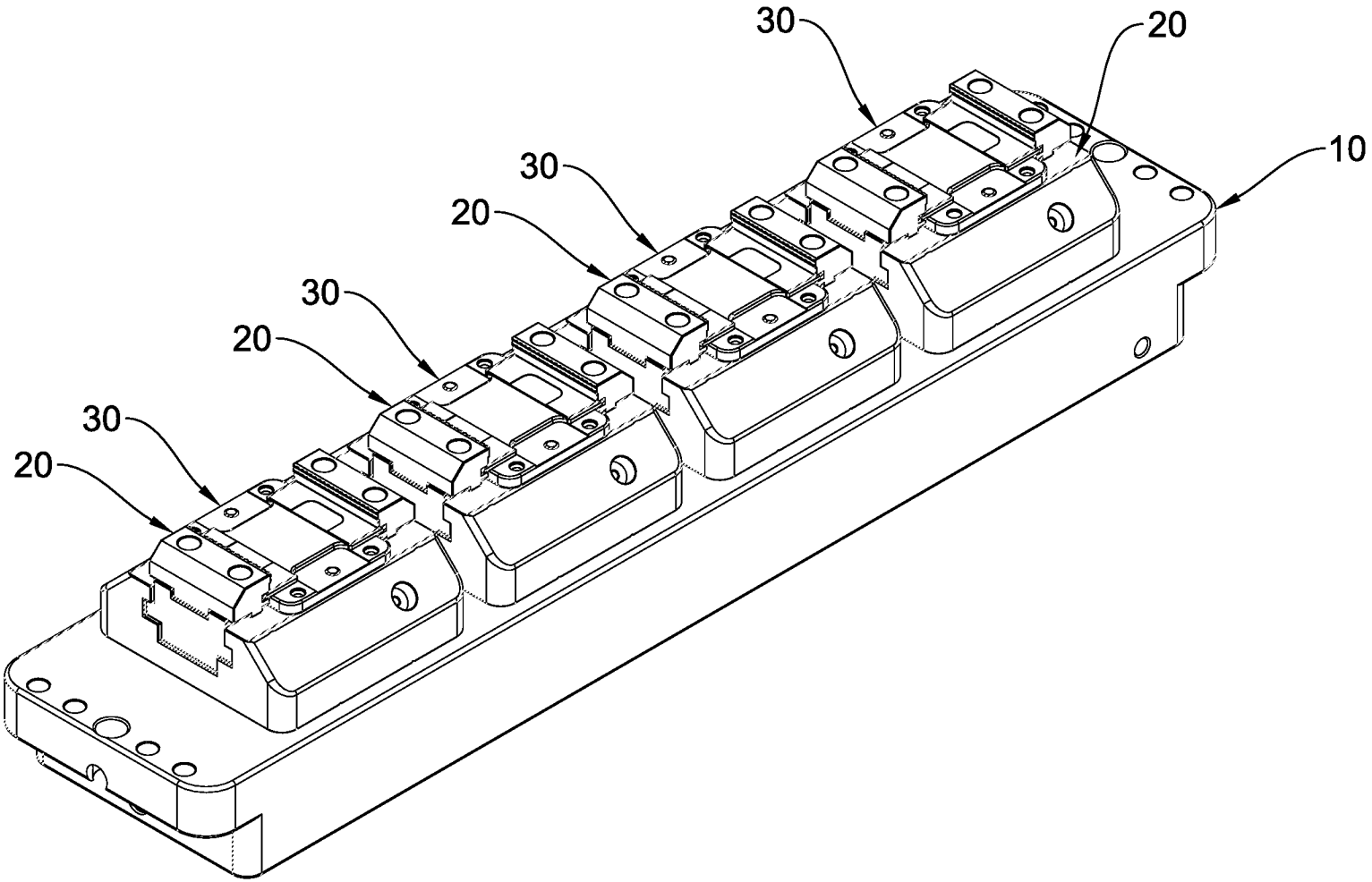
FIG. 1 is a perspective view showing the assembly of an auto-positioning hydraulic pneumatic fixture according to a preferred embodiment of the present invention.

With reference to FIGS. 1-8, an auto-positioning hydraulic pneumatic fixture 100 according to a preferred embodiment of the present invention comprises a base 10 and four locking devices 20.

Referring to FIGS. 1 to 4, the base 10 is mounted on machining equipment (not shown) and includes four installation zones 11, wherein a respective one of the four installation zones 11 is configured to fix a respective one of the four locking devices 20. In this embodiment, the machining equipment is any one of a computer numerical control (CNC) machining center, a CNC lathe, a grinding machine, a CNC grinding machine, and a high-speed cutting machining center, wherein the auto-positioning hydraulic pneumatic fixture 100 is mounted on the CNC machining center, the CNC lathe, the grinding machine, the CNC grinding machine, or the high-speed cutting machining center.

As shown in FIG. 1-8, the respective one locking device 20 is configured to clamp a respective one of multiple workpieces W, and the respective one locking device 20 includes a fixing module 21 and a clamping module 22. The fixing module 21 has a body 211, a connection segment 212, and an affix portion 213, wherein the body 211 is configured to accommodate the connection segment 212 and the affix portion 213, the affix portion 213 has a linear slot 2131 defined thereon so that the affix portion 213 slides along the linear slot 2131.

The connection segment 212 is arranged on a bottom of the body 211 and is connected in the respective one installation zone 11, and the respective one locking device 20 is fixed on the base 10 by ways of multiple coupling elements.

Figure 6:
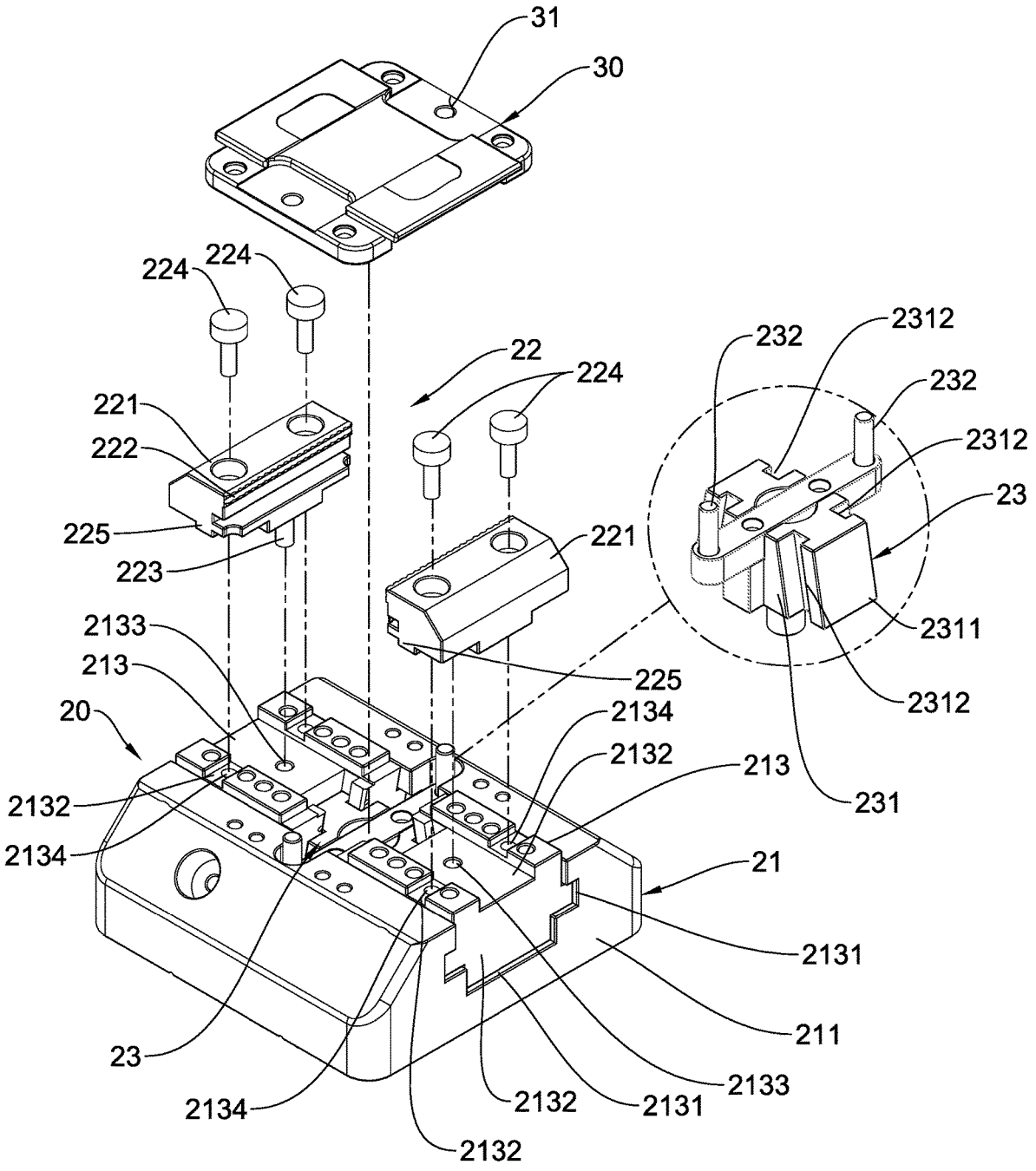
FIG. 6 is a perspective view showing the exploded components of the locking device of the auto-positioning hydraulic pneumatic fixture according to the preferred embodiment of the present invention.
Figure 7:
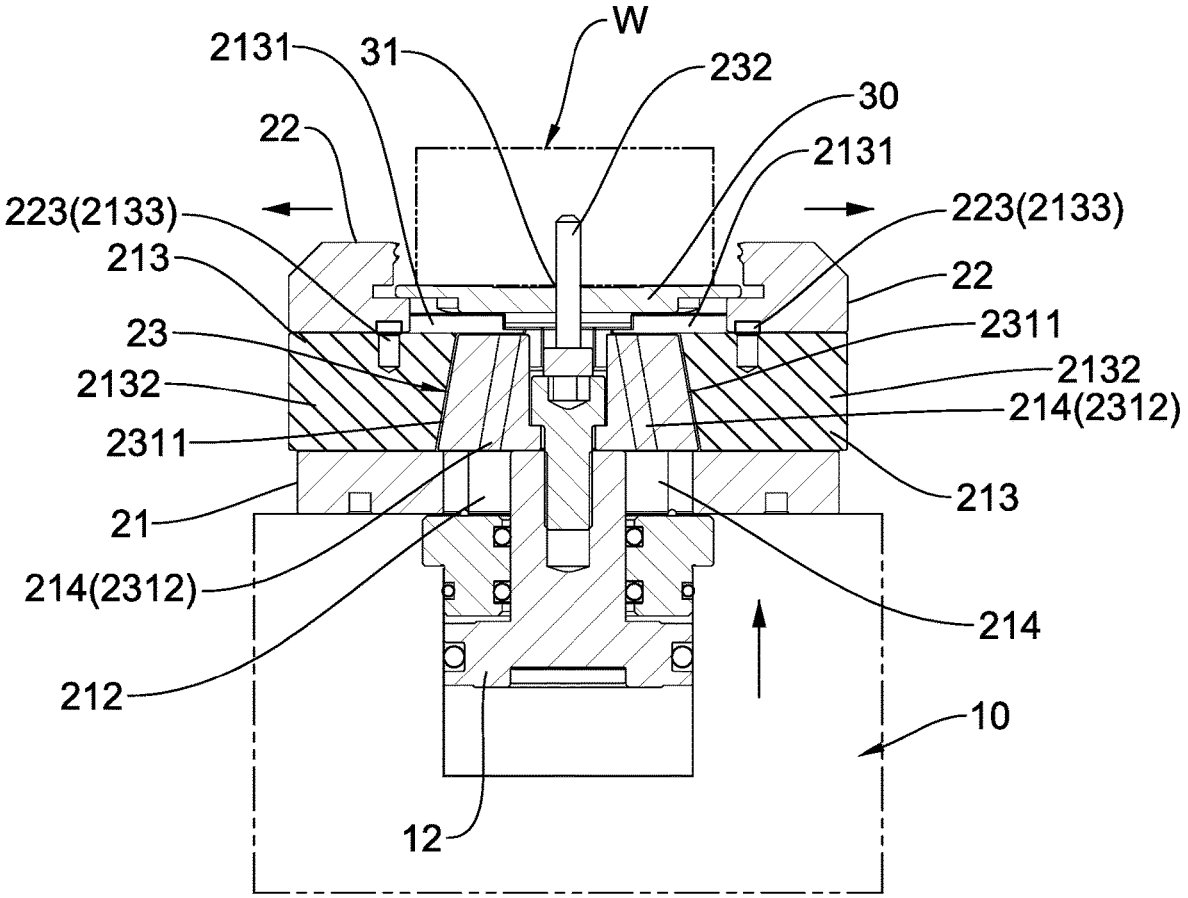
FIG. 7 is a cross sectional view showing the operation of the auto-positioning hydraulic pneumatic fixture according to the preferred embodiment of the present invention.

As shown in FIGS. 6 and 7, the clamping module 22 of the respective one locking device 20 includes a pair of clamp units 221, and a respective one of the pair clamp units 221 has a clamping face 222, the clamping module 22 further includes a positioning bolt 223 extending from a bottom of the respective one clamp unit 221 and inserted into the affix portion 213. The clamping module 22 is secured on the affix portion 213, and the affix portion 213 has a defining groove 2132 configured to accommodate the respective one clamp unit 221 so as to fix the respective one workpiece W, and the respective one clamp unit 221 moves along the linear slot 2131 of the affix portion 213 of the fixing module 21 linearly.

Figure 2:
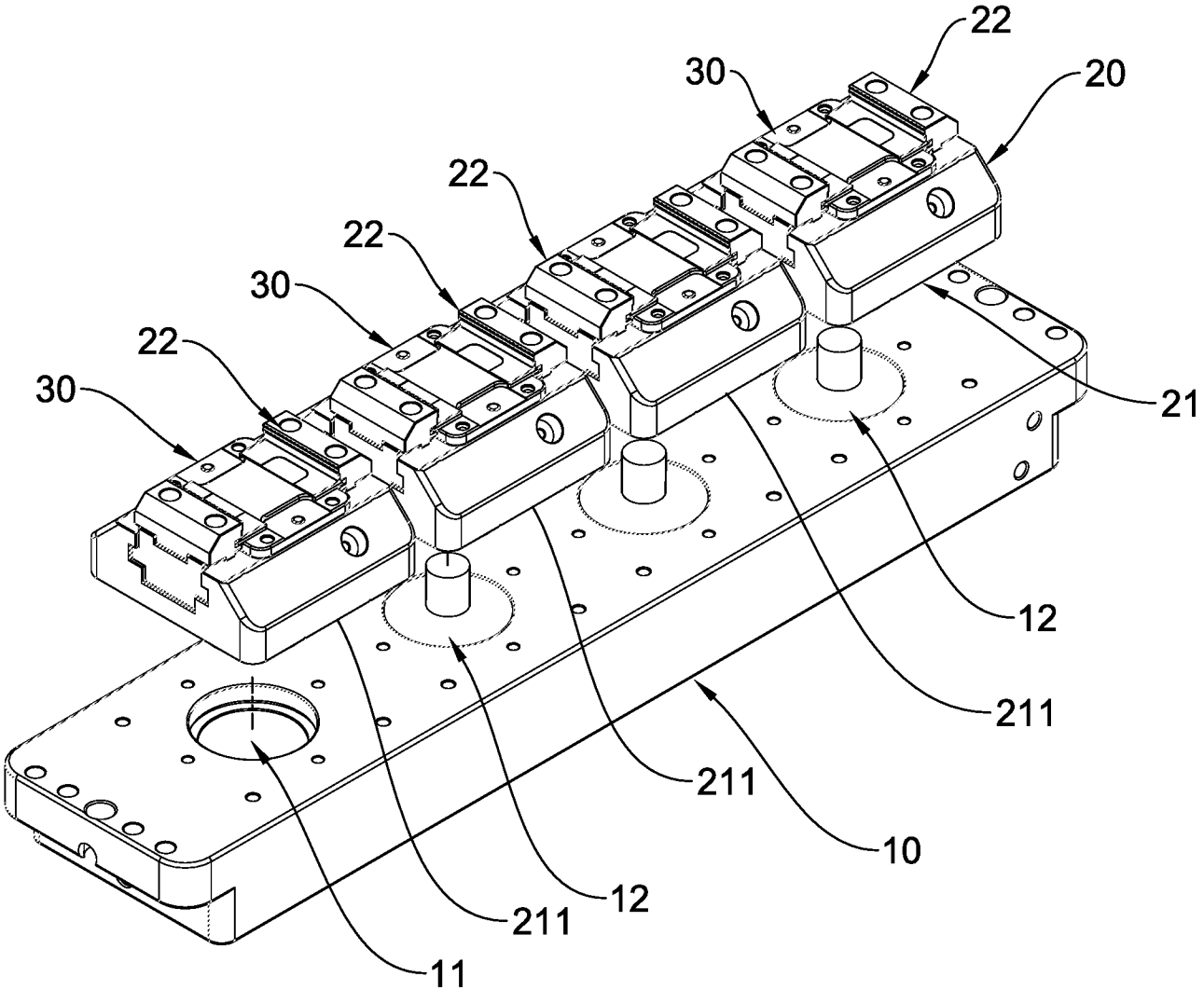
FIG. 2 is a perspective view showing the exploded components of the auto-positioning hydraulic pneumatic fixture according to the preferred embodiment of the present invention.
Figure 3:
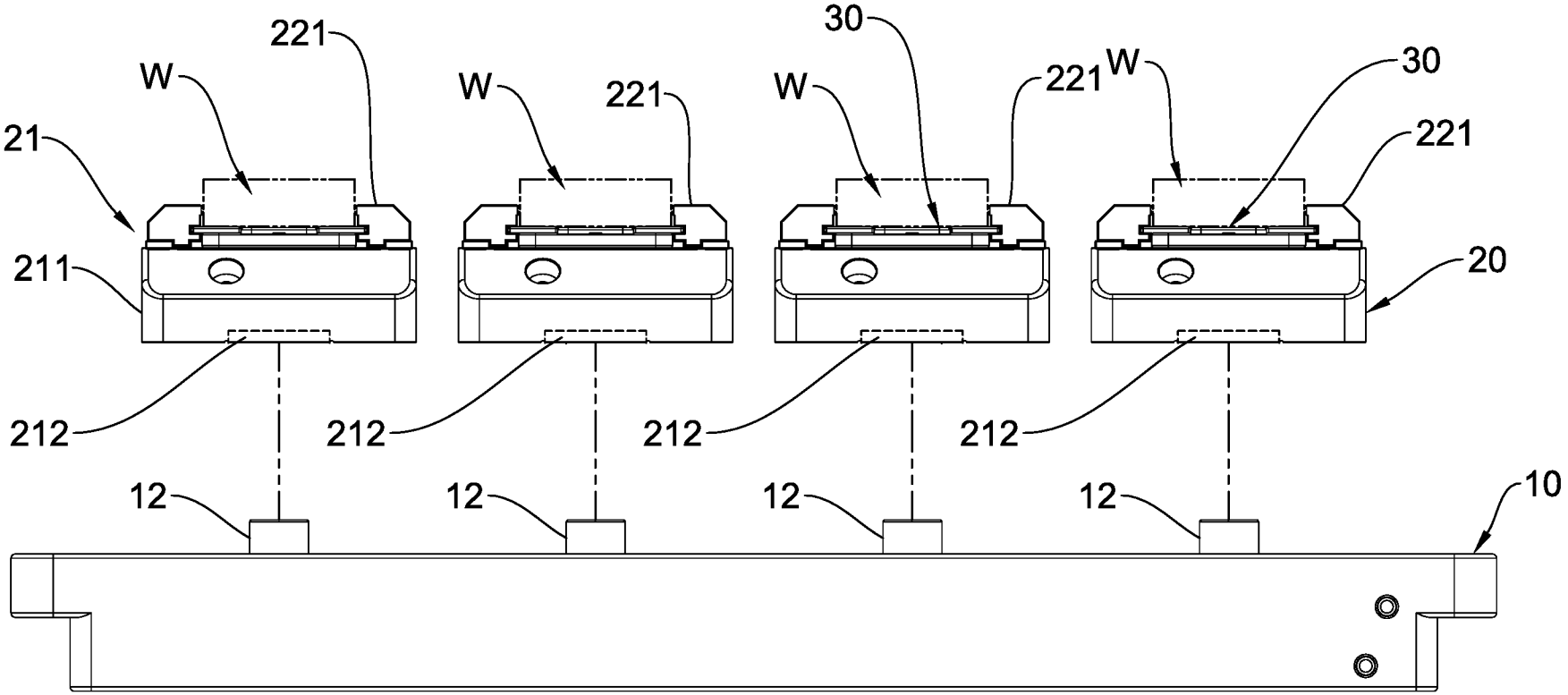
FIG. 3 is another perspective view showing the exploded components of the auto-positioning hydraulic pneumatic fixture according to the preferred embodiment of the present invention.

As illustrated FIGS. 1 and 2, the clamping module 22 is a vise driven pneumatically or hydraulically. Alternatively, the clamping module 22 is a chuck driven pneumatically or hydraulically. The machining equipment mates with pneumatic or hydraulic equipment, wherein a pipe assembly is defined between the machining equipment and the pneumatic or hydraulic equipment and is connected with the clamping module 22 so as to achieve machining automation.

Figure 4:
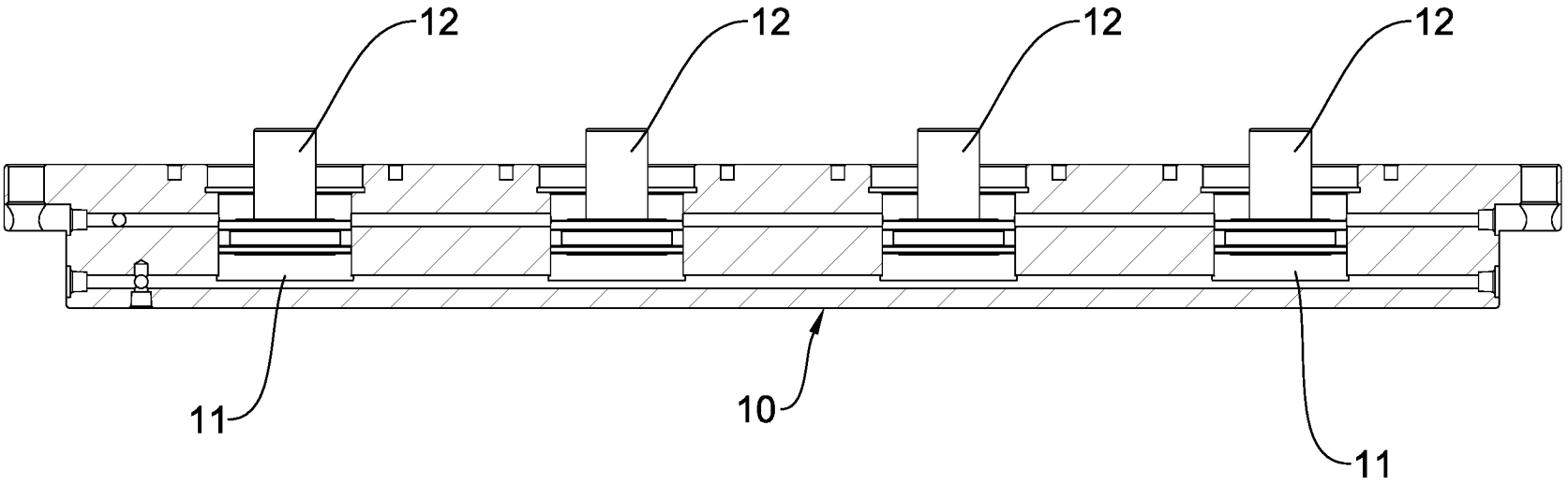
FIG. 4 is a cross sectional view showing the assembly of a base of the auto-positioning hydraulic pneumatic fixture according to the preferred embodiment of the present invention.
Figure 5:
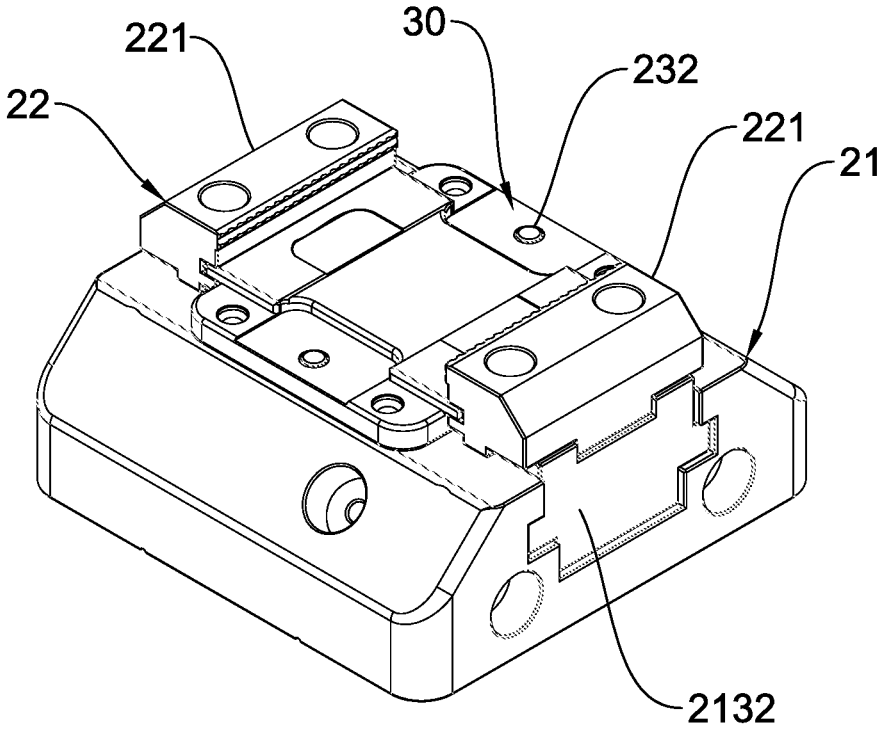
FIG. 5 is a perspective view showing the assembly of a locking device of the auto-positioning hydraulic pneumatic fixture according to the preferred embodiment of the present invention.
Figure 8:
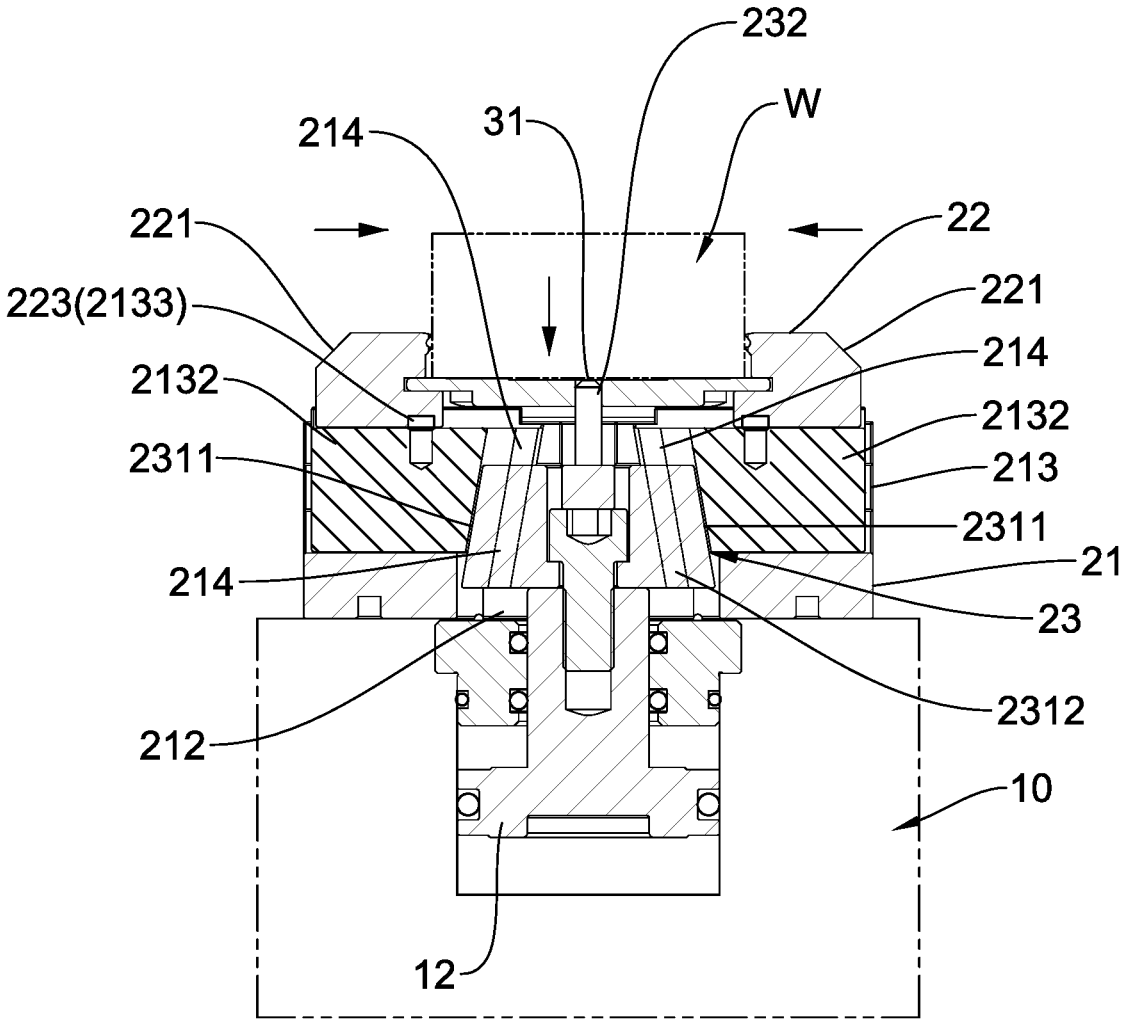
FIG. 8 is another cross sectional view showing the operation of the auto-positioning hydraulic pneumatic fixture according to the preferred embodiment of the present invention.

With reference to FIGS. 2, 4, and 8, an auto-positioning hydraulic pneumatic fixture 100 of the present invention further comprises: multiple pistons 12, multiple positioning modules 23, and multiple platforms 30, wherein a respective one of the multiple pistons 12, the multiple positioning modules 23, and the multiple platforms 30 is fixed in the respective one installation zone 11. The respective one piston 12 moves linearly in the respective one installation zone 11, a first end of the respective one piston 12 is fixed in the respective one installation zone 11, and a second end of the respective one piston 12 is connected with a respective one of the multiple positioning modules 23, wherein the respective one piston 12 moves linearly in the respective one installation zone 11 via a medium. In this embodiment, the respective one piston 12 is pushed to move by compressed air or hydraulic oil.

Referring to FIGS. 7 and 8, the body 211 has at least one tilted rail 214 configured to move the respective one positioning module 23 linearly.

As shown in FIG. 5-9, the respective one positioning module 23 has a mounting unit 231 and two locating units 232, wherein the mounting unit 231 is configured to fix the two locating units 232 which are connected with the respective one piston 12, the mounting unit 231 has two oblique faces 2311 formed on two sides thereof respectively so as to push the affix portion 213, and the mounting unit 231 has multiple fringes 2312 configured to move the mounting unit 231 along the at least one tilted rail 214 of the body 211, such that the respective one positioning module 23 is actuated by the respective one piston 12 to move linearly along the at least one tilted rail 214, and the two locating units 232 extend out of or retract into the fixing module 21 of the respective one locking device 20. In addition, the two locating units 232 of the respective one positioning module 23 are configured to position the respective one workpiece W. In this embodiment, a respective one of the two locating units 232 has a guide end configured to guide and fix the respective one workpiece.

Referring to FIGS. 1, 2, and 5-9, the respective one platform 30 is configured to fix the respective one workpiece W, wherein the respective one platform 30 is formed in a plate shape, and each of two ends of the respective one platform 30 is clamped by the respective one clamp unit 221 of the clamping module 22. Furthermore, the respective one platform 30 includes two orifices 31, and a respective one of the two orifices 31 is configured to extend the respective one locating unit 232.

With reference to FIG. 7, the respective one clamp unit 221 of the clamping module 22 is pushed by a respective one of the two oblique faces 2311 of the mounting unit 231 to extend outward so that the respective one workpiece W is manually or automatically fixed or removed, and the respective one locating unit 232 of the respective one positioning module 23 extends out of the respective one orifice 31 so that the respective one workpiece W is manually or automatically fixed via the guide end of the respective one locating unit 232. In this embodiment, four workpieces W are manually or automatically fixed or removed so as to enhance machining efficiency and availability of the machining equipment.

Figure 9:
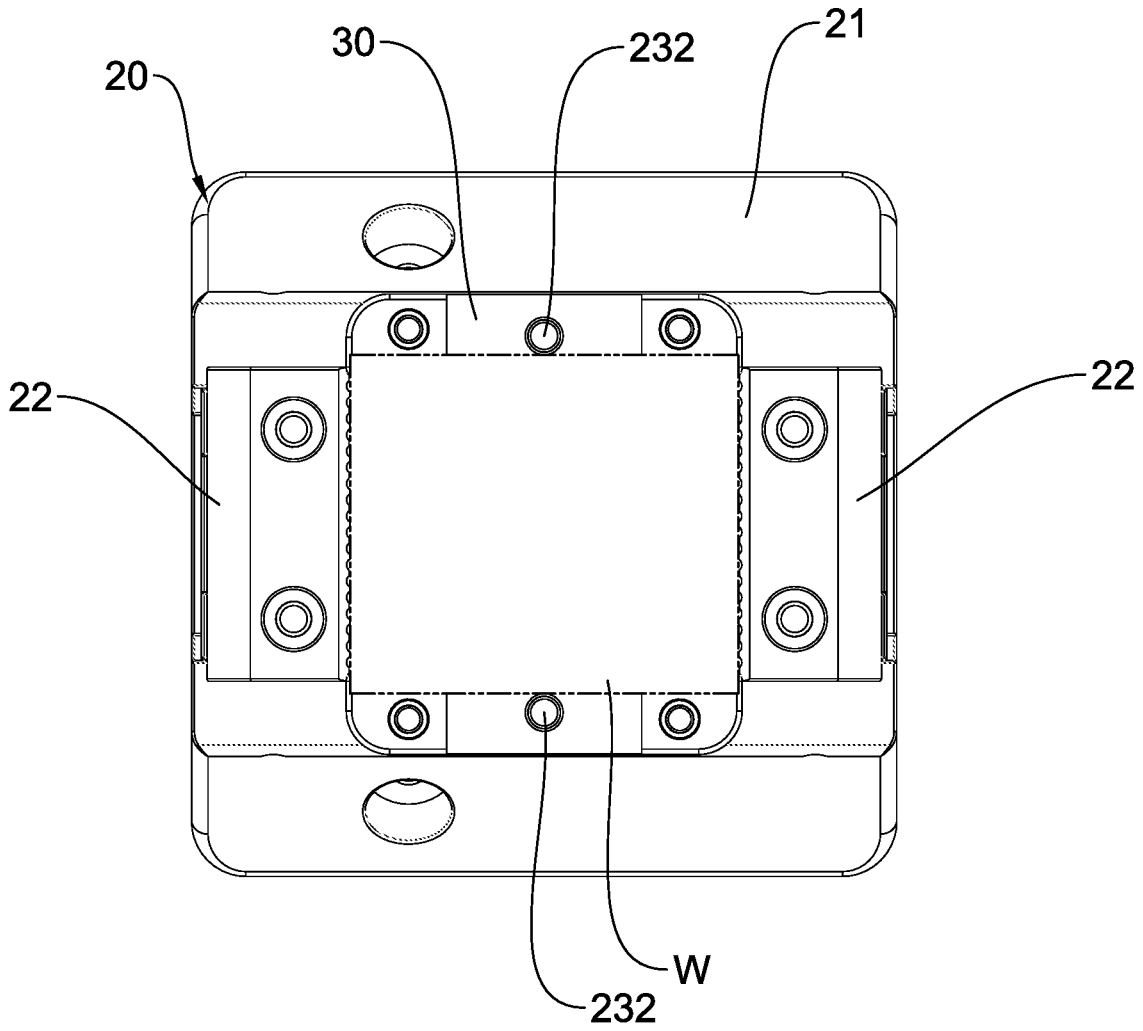
FIG. 9 is a top plan view of FIG. 8.

As shown in FIGS. 8 and 9, the clamping module 22 is started to clamp the respective one workpieces W and the respective one platform 30, the respective one positioning module 23 is driven by the respective one piston 12 to retract into the fixing module 21 to avoid an obstruction of machining process. Thereby, when heavily cutting the respective one workpiece, an obstruction is avoidable. The respective one clamp unit 221 is configured to clamp the respective one workpiece with planes. Alternatively, respective one clamp unit 221 is configured to clamp the respective one workpiece with uneven surfaces by mating with jaw(s).

Accordingly, the auto-positioning hydraulic pneumatic fixture of the present invention has advantages as follows:

1. The respective one positioning module 23 is retracted into the fixing module 21 after clamping the respective one workpiece W, thus avoiding the obstruction of machining process.

2. The auto-positioning hydraulic pneumatic fixture is linked with the machining equipment so as to be driven pneumatically or hydraulically easily.

Figure 10:
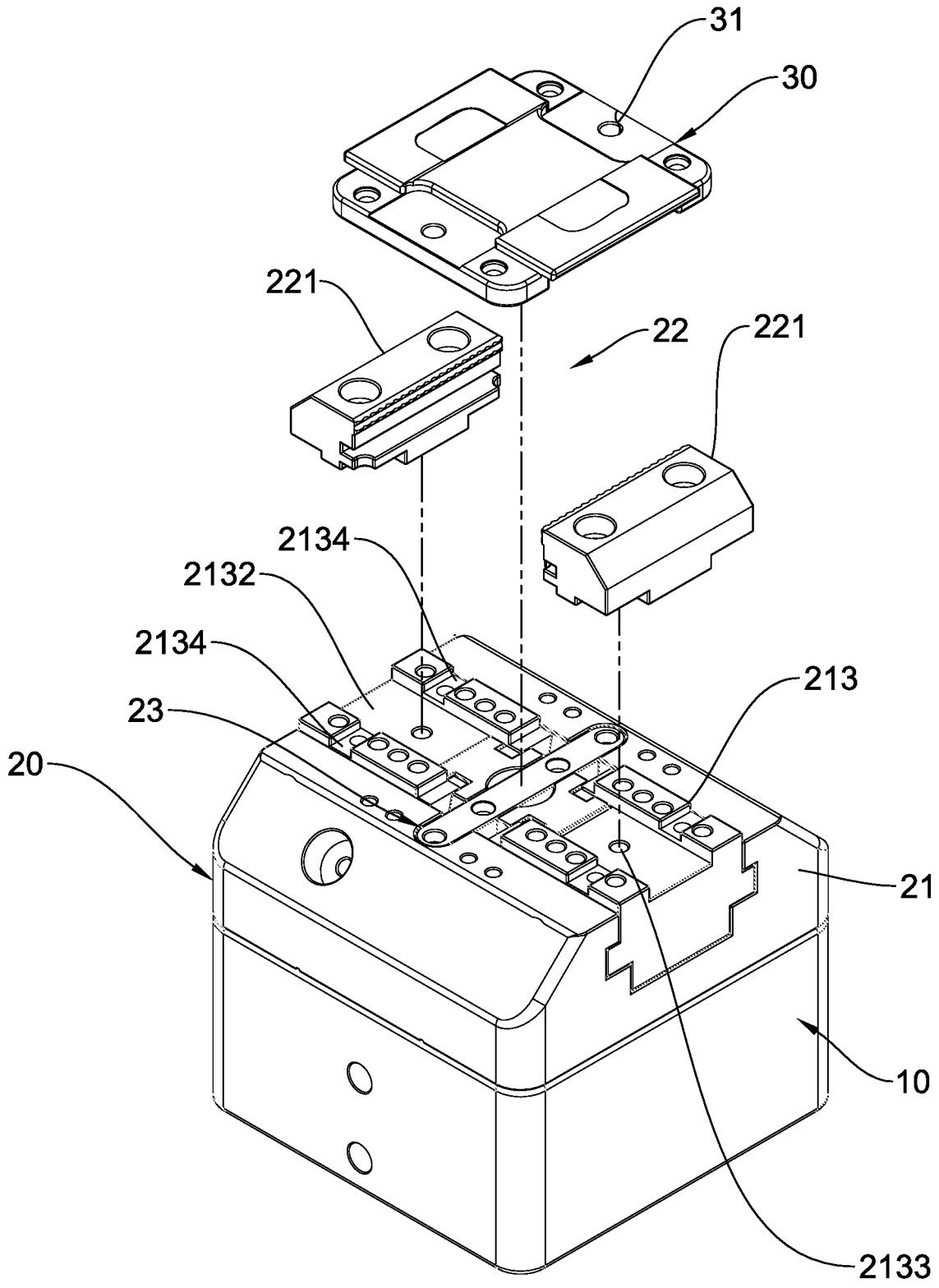
FIG. 10 is a perspective view showing the assembly of an auto-positioning hydraulic pneumatic fixture according to another preferred embodiment of the present invention.

3. Referring to FIG. 10, in another embodiment, the base 10 includes an installation zone 11 applicable for small amount of machining process.

4. The clamping module 22 and the multiple positioning modules 23 of the respective one locking device 20 are actuated linearly by the respective one piston 12 to clamp or unclamp the respective one workpiece W, thus simplifying clamping operation.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An auto-positioning hydraulic pneumatic fixture comprising a base and at least one locking device;

the base being mounted on machining equipment and including at least one installation zone, and a respective one of the at least one installation zone being configured to fix a respective one of the at least one locking device;

the respective one locking device being configured to clamp a respective one of at least one workpiece, and the respective one locking device including a fixing module and a clamping module, the fixing module having a body, a connection segment, and an affix portion, the body being configured to accommodate the connection segment and the affix portion;

the connection segment being arranged on a bottom of the body and being connected in the respective one installation zone, and the respective one locking device being fixed on the base by ways of multiple coupling elements;

the clamping module of the respective one locking device including a pair of clamp units, and a respective one of the pair of clamp units having a clamping face, the clamping module further including a positioning bolt extending from a bottom of the respective one clamp unit and inserted into the affix portion, the clamping module being secured on the affix portion, and the affix portion having a defining groove configured to accommodate the respective one clamp unit so as to fix the respective one workpiece, the affix portion having a linear slot so that the affix portion slides along the linear slot to actuate the respective one clamp unit to clamp the respective one workpiece, and the respective one clamp unit moving along of the affix portion of the fixing module linearly;

wherein the auto-positioning hydraulic pneumatic fixture further comprises: multiple pistons, multiple positioning modules, and multiple platforms, wherein a respective one of the multiple pistons, the multiple positioning modules, and the multiple platforms is fixed in the respective one installation zone, a first end of the respective one piston is fixed in the respective one installation zone, and a second end of the respective one piston is connected with a respective one of the multiple positioning modules, wherein the respective one piston moves linearly in the respective one installation zone via a medium;

wherein the body has at least one tilted rail configured to move the respective one positioning module linearly;

wherein the respective one positioning module has a mounting unit and at least one locating unit, the mounting unit is configured to fix the at least one locating unit which is connected with the respective one piston, the mounting unit has two oblique faces formed on two sides thereof respectively so as to push the affix portion, and the mounting unit has multiple fringes configured to move the mounting unit along the at least one tilted rail of the body, such that the respective one positioning module is actuated by the respective one piston to move linearly along the at least one tilted rail, and the at least one locating unit extends out of or retracts into the fixing module of the respective one locking device, wherein the at least one locating unit of the respective one positioning module is configured to position the respective one workpiece;

wherein the respective one platform is configured to fix the respective one workpiece, the respective one platform is formed in a plate shape, and each of two ends of the respective one platform is clamped by the respective one clamp unit of the clamping module, wherein the respective one platform includes at least one orifice, and a respective one of the at least one orifice is configured to extend a respective one of the at least one locating unit;

wherein when unclamping the respective one workpiece, the respective one clamp unit of the clamping module is pushed by the mounting unit to extend outward, and the respective one locating unit of the respective one positioning module extends out of the respective one orifice so that the respective one workpiece is fixed; and wherein when clamping the respective one workpiece, the clamping module is not pushed by the mounting unit and retracts inward to clamp the respective one workpiece and the respective one platform, and the respective one locating unit of the respective one positioning module is actuated by the respective one piston to retract into the fixing module.

2. The auto-positioning hydraulic pneumatic fixture as claimed in claim 1, wherein the respective one locating unit has a guide end.

3. The auto-positioning hydraulic pneumatic fixture as claimed in claim 1, wherein the medium is compressed air configured to push the respective one piston to move in the respective one installation zone.

4. The auto-positioning hydraulic pneumatic fixture as claimed in claim 1, wherein the medium is hydraulic oil configured to push the respective one piston to move in the respective one installation zone.

5. The auto-positioning hydraulic pneumatic fixture as claimed in claim 1, wherein the clamping module clamps or unclamps the respective one workpiece by ways of the medium.

6. The auto-positioning hydraulic pneumatic fixture as claimed in claim 1, wherein the clamping module is a vise or a chuck driven by the medium.

* * * * *